United States Patent [19]

Matsuda et al.

[11] Patent Number: 4,822,258

[45] Date of Patent: Apr. 18, 1989

[54] IN-TANK FUEL PUMP

[75] Inventors: Takashi Matsuda; Ryozo Suzuki; Shingo Iwai; Ryoji Ikeda, all of Hiroshima, Japan

[73] Assignee: Mitsubishi Denki Kabushiki Kaisha, Japan

[21] Appl. No.: 148,915

[22] Filed: Jan. 27, 1988

[30] Foreign Application Priority Data

Jan. 30, 1987 [JP] Japan ..... 62-13199

[51] Int. Cl.[4] ..... F04B 17/00; F04B 39/00

[52] U.S. Cl. ..... 417/423.3; 417/366; 415/53 T; 415/213 T

[58] Field of Search ..... 417/366, 369, 370, 423 B, 417/423 T; 415/53 T, 213 T

[56] References Cited

U.S. PATENT DOCUMENTS

| | | | |
|---|---|---|---|
| 4,205,947 | 6/1980 | Ruhl et al. | 417/366 X |
| 4,231,718 | 11/1980 | Ruhl et al. | 417/366 |
| 4,336,002 | 6/1982 | Rose et al. | 417/203 |
| 4,538,968 | 9/1985 | Kusakawa | 417/369 X |
| 4,591,311 | 5/1986 | Matsuda et al. | 417/366 X |
| 4,642,030 | 2/1987 | Friebe et al. | 417/366 |
| 4,692,092 | 9/1987 | Matsuda et al. | 417/366 X |

FOREIGN PATENT DOCUMENTS

| | | |
|---|---|---|
| 46-26442 | 7/1971 | Japan . |
| 61-99692 | 6/1986 | Japan . |
| 940510 | 10/1963 | United Kingdom . |
| 949576 | 2/1964 | United Kingdom . |
| 1043468 | 9/1966 | United Kingdom . |
| 1581387 | 12/1980 | United Kingdom . |

*Primary Examiner*—Carlton R. Croyle
*Assistant Examiner*—Eugene L. Szczecina, Jr.
*Attorney, Agent, or Firm*—Leydig, Voit & Mayer

[57] ABSTRACT

An in-tank type fuel pump in which an impeller within the pump chamber is rotated by a motor disposed within a fuel chamber within a main body to pump fuel. A through hole in communication with a fuel chamber of the motor portion is provided in a side wall of the pump chamber on the motor side close to the upstream end of the annular channel defining the fuel chamber of the motor portion.

1 Claim, 1 Drawing Sheet

IN-TANK FUEL PUMP

BACKGROUND OF THE INVENTION

This invention relates to an in-tank fuel pump mounted within a fuel tank of an automobile and more particularly to means for removing bubbles generated in the pump.

FIG. 1 is a sectional view showing a conventional in-tank fuel pump disclosed in Japanese U.M. Laid Open No. 61-99692, for example, and in the figure, 1 is a main body defining an outer shell of the pump, 2 is a cylindrical yoke, 3 is a cover placed over one end of the yoke 2, 3A is a discharge pipe projecting toward the outside of the cover 3 for discharging the fuel in the fuel chamber 4 outside of the main body 1, 3B is a discharge passage projecting toward the inside of the cover 3 for introducing the fuel in the fuel chamber 4 into the discharge pipe 3A, and 3C is a relief port formed in the cover 3 and located in the upper portion of the fuel chamber for relieving bubbles in the fuel chamber 4 to the exterior. 5 is a bracket placed over the yoke 2 and positioned by a step portion 2A, 5A is a first through hole formed in the bracket 5 for allowing the insertion of the commutator 14, 5B is a second through hole for supplying the fuel pumped by the impeller 16 to the fuel chamber 4, 5C is an injection pipe formed in continuation with the second through hole 5B of the bracket 5, 6 is a pump cover embedded into the bracket 5 and placed over the yoke 2, 6A is a suction or fuel inlet pipe projecting toward the outside of the pump cover 6 for sucking the fuel to the pump chamber 7, 8 is a first metal bearing inserted into the recessed portion of the cover 3 and secured by a metal holder 9, 10 is a second metal bearing inserted into the recessed portion of the pump cover 6 and 11 is a motor which comprises a main shaft 12 journaled at the opposite ends by the first metal bearing 8 and the second metal bearing 10. An armature 13 with the commutator 14 is mounted on the main shaft 12 and a magnet 15 secured at the inside of the yoke 2 so as to oppose the armature 13. 14A is a plurality of projecting portions which project from the commutator 14 substantially parallel to the main shaft 12. 16 is an impeller inserted into the main shaft 12 and the projecting portions 14A of the commutator 14, the outer periphery of which is formed into a blade. 17 is a brush assembly for supplying electrical power to the commutator 14, and 18 is a terminal connected to the brush assembly 17 for supplying electrical power from the exterior.

The description will now be made as to the operation of the conventional fuel pump as above-constructed.

Firstly, when external electrical power is supplied to the brush assembly 17 through the terminal 18, the motor 1 is electromagnetically driven to rotate the armature 13. Therefore, the impeller 16 mounted on the main shaft 12 is rotated by the rotational force transmitted through the projecting portion 14A of the commutator 14. This causes the fuel to flow from the suction pipe 6A into the pump chamber 7, then the fuel is pumped by the blade formed on the outer periphery of the impeller 16 and transferred under pressure to the fuel chamber 4 through the second through hole 5B. The fuel thus filled in the fuel chamber 4 is pressurized by the pressure of the fuel pumped by the impeller 16, and pumped out from the discharge pipe 3A to an unillustrated automotive carburator for example.

In the conventional in-tank fuel pump as above described, the blade shaped portions at the outer periphery of the impeller 16 agitate the fuel by the rotation of the impeller 16 and generate bubbles. When the amount of the bubbles generated is increased or when the automobile makes a tight turn with only a slight amount of fuel remaining in the tank, the air within the tank is temporarily sucked into the pump chamber, making the interior of the pump chamber fill with a vapor-liquid mixture. If the amount of vapor becomes too great, the blade of the impeller 16 rotates in the vapor, posing the problem that the pumping action is lost and the fuel cannot be pumped to the automotive carburator.

SUMMARY OF THE INVENTION

This invention has been made in order to solve the above problem and has as its object the provision of an in-tank fuel pump in which the air which may enter into the pump chamber can be quickly removed from the main body to maintain a normal fuel suction and discharge function, ensuring that a device on the downstream of the fuel pump can be properly operated.

According to the in-tank fuel pump of the present invention, a through hole in communication with the fuel chamber of the motor portion is formed in an annular channel of the bracket defining an upper wall of a pump chamber at a position close to the suction side.

With the in-tank fuel pump of the present invention, even when a large number of bubbles are generated in the pump chamber by the rotation of the impeller or when a large amount of air is sucked from the exterior into the pump chamber, the fuel disposed in the fuel chamber is supplied through the through hole formed in the bracket to the blade-shaped portion of the impeller, whereby the pumping function can be restored to suck fresh fuel from the suction pipe and to quickly discharge the above vapor to the outside of the main body through the discharge port.

BRIEF DESCRIPTION OF THE DRAWINGS

The present invention will become more readily apparent from the following detailed description of the preferred embodiment of the invention taken in conjunction with the accompanying drawings, in which.

DESCRIPTION OF THE PREFERRED EMBODIMENT

Figure 2:
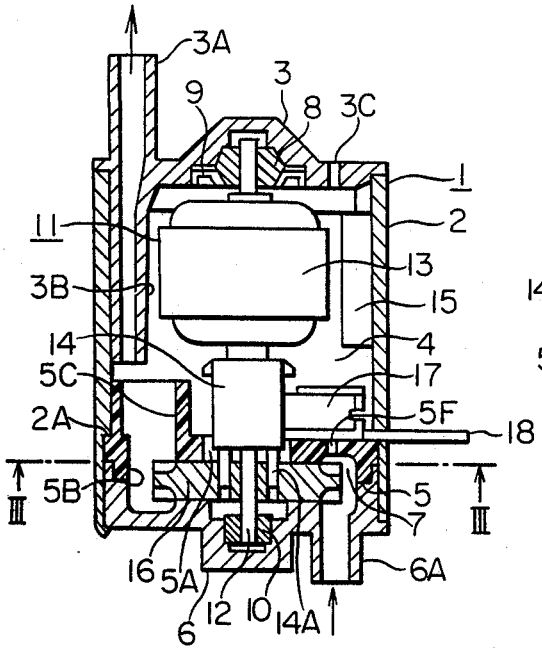
FIG. 2 is a longitudinal sectional view illustrating one embodiment of the present invention.
Figure 3:
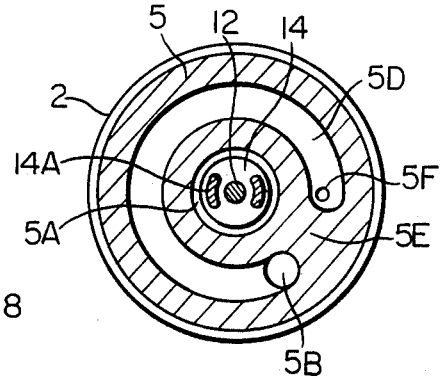
FIG. 3 is a cross sectional view taken along line III13 III of FIG. 2.

FIGS. 2 and 3 illustrate one embodiment of the present invention.

In the figures, 5D is an annular channel formed in the bracket 5. The fuel introduced into the pump chamber 7 from the suction pipe 6A which flows along the annular channel 5D, while being pressurized by the impeller 16, impinges against the liquid seal portion 5E partitioning the suction pipe 6A and the second through hole 5B and is supplied to the fuel chamber 4 in the motor through the second through hole 5B and the injection pipe 5C. 5F is a through hole formed in the annular channel 5D of the bracket 5 at the position close to the suction side to communicate with the fuel chamber 4 of the motor unit.

Figure 1:
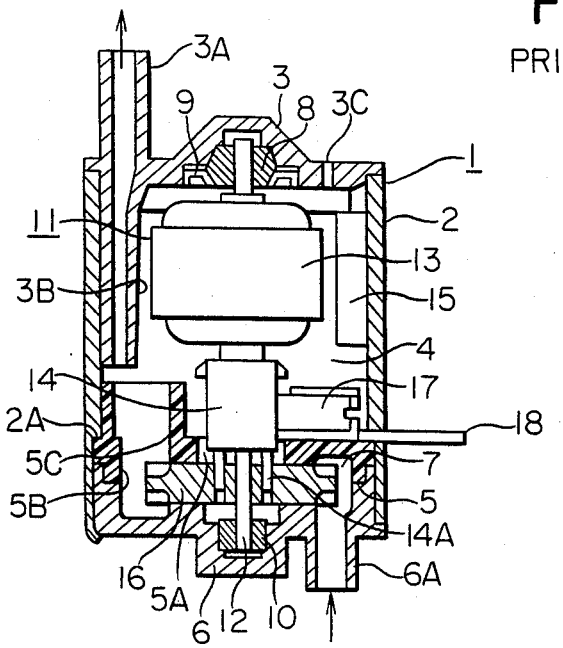
FIG. 1 PRIOR ART
FIG. 1 is a longitudinal sectional view illustrating a conventional example.

The components other than those described above and indicated by the same reference numerals are similar to or the same as those described in conjunction with FIG. 1 and their description will be omitted.

With the in-tank fuel pump of the present invention, even when a large amount of bubbles are generated within the pump chamber 7 by the rotation of the impeller 16, or even when air is temporarily sucked into the tank when the vehicle makes a tight turn with only a small amount of fuel remaining in the tank, the liquid fuel within the fuel chamber 4 is supplied to the blade-shaped grooved portions of the impeller 16 so that the usual pumping function can be recovered. Thereby fresh fuel is suctioned through the suction pipe 6A and the bubbles generated in the pump and the air introduced thereinto are quickly discharged from the injection pipe 5C by way of the fuel chamber 4 through the discharge port 3C of the cover 3 to the exterior of the main body 1.

Although the fuel circulates between the pump chamber 7 and the fuel chamber 4 since a portion of the fuel within the fuel chamber 4 is sucked through the through hole 5F, the amount of this fuel is very small and no substantial loss appears in the working of the pump.

As has been described, according to the present invention, a through hole in communication with the fuel chamber of the motor portion is formed in an annular channel of the bracket defining an upper wall of a pump chamber at the position close to the suction side, so that even when a large number of bubbles are generated in the pump chamber by the rotation of the impeller or when a large amount of air is suctioned from the exterior into the pump chamber, the fuel disposed in the fuel chamber can be supplied through the through hole formed in the bracket to the blade-shaped portion of the impeller, whereby fresh fuel can be introduced from the suction pipe and the above air can be quickly discharged through the discharge port to the outside of the main body. Accordingly, the pumping function is quickly restored and the performance of the apparatus in the subsequent steps is not decreased.

What is claimed is:

1. An in-tank type fuel pump having a body including a fuel inlet, a pump chamber and a fuel chamber, an impeller disposed in said pump chamber, a motor for rotating said impeller, said motor being disposed in said fuel chamber, wherein said fuel chamber includes, adjacent said pump chamber, an annular channel in communication with said pump chamber and a through hole opening into said channel, said fuel inlet, and said fuel chamber, to establish communication therebetween, whereby liquid fuel may flow from said fuel chamber into said pump chamber.

* * * * *